US005407413A

United States Patent [19]

Kupferman

[11] Patent Number: 5,407,413

[45] Date of Patent: Apr. 18, 1995

[54] FITNESS EXCERCISE BAR SYSTEM

[76] Inventor: Scott J. Kupferman, 10 Margo La., Huntington, N.Y. 11743

[21] Appl. No.: 1,173

[22] Filed: Jan. 7, 1993

[51] Int. Cl.[6] ..... A63B 21/075

[52] U.S. Cl. ..... 482/106; 482/93; 482/107; 482/108

[58] Field of Search ..... 482/105, 106, 108, 107

[56] References Cited

U.S. PATENT DOCUMENTS

| | | | |
|---|---|---|---|
| D. 194,042 | 11/1962 | Guthormsem | 482/106 |
| 2,447,218 | 8/1948 | Trzesniewski | 481/106 |
| 4,913,422 | 4/1990 | Elmore et al. | 482/105 |

*Primary Examiner*—Richard J. Apley
*Assistant Examiner*—Jerome Donnelly
*Attorney, Agent, or Firm*—Richard S. Milner

[57] ABSTRACT

A fitness exercise bar system and method which includes a rod and interchangeable weight rings which attach to each other and to a collar ring attached to the rod by using complementary connectors formed along a circumference on the surface of each side of each weight ring. Each weight ring is at least partially surrounded by a soft-coating which compresses under pressure allowing the complementary connectors to be moved closer together. The complementary connectors are of the kind which connect and release by first being moved together and then being pushed apart. Since the soft-coating can be compressed and then released, the soft-coating enables the user to press the weights together, attach the connectors and then release the weights thereby locking the connectors and thus, the weights, together.

16 Claims, 5 Drawing Sheets

FITNESS EXCERCISE BAR SYSTEM

FIELD OF THE INVENTION

The present invention relates to a fitness exercise bar system for use as a dumbbell, barbell, curl bar or similar exercise device which includes interchangeable soft-coated weights which attach to each other and to the exercise bar by a simple 'press-and-turn' motion.

BACKGROUND OF THE INVENTION

Fitness exercise bar systems, such as dumbbells or barbells or curl bars, which use interchangeable weights are well known in the art. A typical system employs an elongate bar or rod, removable hard-surface weights and some mechanism for retaining the weights on the bar.

Most such fitness exercise bar systems retain the interchangeable hard-surface weights on a bar by employing a collar formed as part of, or attached to, the bar and a movable end piece which is removably attached to the bar. In operation, interchangeable weights are slid onto the bar and locked between the moveable endpiece and the collar. In one variation, the bar itself is modified to provide a threaded flange for the moveable endpiece, see, for example, U.S. Pat. No. 4,738,446 to Miles. However, in exercise bar systems of this type, the hard-surface weights are not connected to each other and can rotate and slide horizontally when being used if the interchangeable weights are not tightly clamped between the moveable endpiece and the collar.

Some other types of fitness exercise bar systems use hard-surface weights which attach directly to the each other and to the ends of the bar. U.S. Pat. No. 4,566,690 to Schook ("'690 patent") is an example of this type. In the '690 patent, each weight is formed with a single male connector on one side and a single female connector on the other side. The individual weights can be connected to each other by joining the weights together and to a collar at the end of the bar. However, aligning the centrally located cylindrical connectors without the guidance and support provided by a central bar or additional guides can be difficult. Furthermore, attaching a hard-surface weight to an adjoining hard-surface weight requires that an individual weight be spun about the handle to insure a tight fit between the weights. Also, the '690 patent does not provide any means for "locking" the weights together once the weights are connected to each other.

Another type of fitness exercise bar system attaches each hard-surface weight directly to the handlebar. U.S. Pat. No. 4,453,710 to Plotz ("'710 patent") shows a bar formed with tabs along at least part of the bar. Each weight in the '710 patent has complementary stops formed along the weight's center hole to engage the stops and, when twisted, lock the weight to the handlebar. However, this system requires that weights be positioned only in specific places along the bar, that is, where the tabs are positioned.

Also, in the prior art, weights of different masses typically have different diameters. In these systems, using different weights on each end of the handlebar, for example, a 1 kilogram weight and a 3 kilogram weight on one end and a single 4 kilogram weight on the other end, creates a geometric imbalance, although the total mass, 4 kilograms, is the same.

Therefore, there is a need for a fitness exercise bar system which overcomes the deficiencies of the prior art systems discussed above.

SUMMARY OF THE INVENTION

An object of the present invention is to provide an exercise fitness bar system in which interchangeable weights can be easily attached to each other and to the bar with a simple 'push-and-turn' action.

Another object of the present invention is to provide an exercise fitness bar system in which interchangeable weights are locked together such that the weights do not rotate or slip along or around the exercise bar when being used.

A further object of the present invention is to provide an exercise fitness bar in which the interchangeable weights have multiple connectors formed on each side of each of the weights to provide multiple attachment points between the weights and/or the bar.

Another object of the present invention is to provide a fitness exercise bar system in which the axial length of the weights is varied for different masses while the diameter of each weight is fixed.

A further object of the present invention is to provide a fitness exercise bar system where all the weights have the same diameter regardless of the mass of each weight thereby preventing a geometric imbalance between the sides of the bar.

An additional object of the present invention is to provide interchangeable weights which can be connected to each other without the bar for storage and transport.

Another object of the present invention is to provide a fitness exercise bar system for those people who wish to increase muscular strength and endurance and thereby obtain a healthier and more fit physique.

A further object of the present invention is to provide an exercise fitness bar system which will allow quick mounting and dismounting of the interchangeable weights thereby reducing the amount of set-up time for different exercises requiring respective different amounts of resistance. This reduced set-up time encourages users of the present invention to use the appropriate resistance for each exercise as taught by numerous fitness principles.

Another object of the present invention is to provide attractive interchangeable weights and bars which can be manufactured in any number of color combinations to provide attractive packaging and an appealing look for users.

This invention provides a fitness exercise bar system comprising a rod comprising a central core and a first soft-coating attached to at least a portion of the central core; a plurality of collar rings attached to the rod, each collar ring comprising a first core ring, a first central hole, a first edge, a first side, a second side, a first plurality of connectors formed in the first side and a second soft-coating attached to the first core ring to form a soft surface on the first side, the second side and the first edge; and a plurality of weight rings, each weight ring comprising a second core ring, a second central hole, a second edge, a third side, a fourth side, a second plurality of connectors formed in the third side, a third plurality of connectors formed in the fourth side and a third soft-coating attached to the second core ring to form a soft surface on the third side, the fourth side and the second edge; such that the second plurality of connectors are adapted to connect to the first plurality of connectors and the second plurality of connectors are adapted to connect to the third plurality of connectors.

This invention also provides that each of the first plurality of connectors and each of the third plurality of connectors comprise a first type of connector and each of the second plurality of connectors comprises a second type of connector which is complementary to the first type of connector.

Additionally, this invention provides for a first type of connector comprising a post comprising a shaft and a head, the head being wider in at least one dimension than the shaft and a second type of connector comprising an elongate hole comprising a first region and a second region, the first region comprising an opening for receiving the head and the second region comprising an opening narrower in the at least one dimension than the head and wider in the at least one dimension than the shaft; such that a post, when inserted into the elongate hole, can slide from the first region to the second region.

Alternatively, this invention provides for a first type of connector comprising a post comprising a shaft and a head, the head being wider in at least one dimension than the shaft and a second type of connector comprising a hole comprising a first region and a second region, the first region comprising an opening for receiving the head and the second region comprising an indentation formed adjacent to the bottom of the first region such that the head of the post, when inserted into the hole, can be at least partially slid into the indentation.

This invention also provides that each weight ring and each collar ring further comprises a predetermined diameter.

Also, this invention provides that the first plurality of connectors comprise three connectors evenly spaced around a circumference at a predetermined radial distance from the first central hole; the second plurality of connectors comprise three connectors evenly spaced around the circumference; and the third plurality of connectors comprise three connectors evenly spaced around the circumference.

Additionally, this invention provides that the soft-coating of each weight ring, the soft-coating of each collar ring and the first soft-coating of the rod comprises rubber or neoprene wrapping.

This invention also provides a fitness exercise bar system comprising a rod comprising a central core; a plurality of rings, each ring comprising a core ring, a plurality of connectors and a soft-coating attached to at least a portion of the core ring. Also, this invention provides that the rod further comprises a soft-coating attached to at least a portion of the central core and that the plurality of rings comprise a plurality of weight rings and a plurality of collar rings attached to said rod. Additionally, this invention provides that the plurality of connectors are formed in at least one side of each of the plurality of rings for removably attaching at least one side of one ring of the plurality of rings to at least one side of another ring of the plurality of rings. Also, this invention provides that at least a portion of said soft-coating is attached to each core ring such that the soft-coating compresses for removably attaching one ring of the plurality of rings to another ring of the plurality of rings and at least partially decompresses for locking one ring to another ring.

Also provided by this invention is a fitness exercise bar system comprising a rod; a plurality of rings, each ring comprising a central hole, an edge, a first side and a second side, a plurality of connectors formed on at least one of the sides along a circumference having a predetermined radial distance from the central hole, the plurality of connectors adapted to connect one ring of the plurality of rings to another ring of the plurality of rings.

This invention also provides a method of attaching weights to each other, where each weight comprises a core, a soft-coating and a plurality of connectors, comprising the steps of aligning the plurality of connectors of one weight with the plurality of connectors of another weight such that each of the plurality of connectors of the one weight is complementary to a respective connector of the plurality of connectors of another weight, positioning the plurality of connectors of one weight and the plurality of connectors of another weight into a disengaged position, pressing one weight against another weight thereby compressing the soft-coating and engaging the plurality of connectors of one weight and the plurality of connectors of another weight from the disengaged position into a first engaged position, further engaging the plurality of connectors of one weight and the plurality of connectors of another weight from the first engaged position to a second engaged position, and cease pressing one weight against another weight allowing the soft-coating to at least partially decompress and thereby lock the plurality of connectors of one weight and the plurality of connectors of another weight from the second engaged position into a locked position. Additionally, this invention provides that the step of further engaging the plurality of connectors of one weight and the plurality of connectors of another weight comprises the step of turning one weight relative to another weight to move the plurality of connectors of the one weight from the first engaged position to the second engaged position.

This invention also provides a method of detaching locked weights from each other, where each weight comprises a core, a soft-coating and a plurality of connectors, comprising the steps of pressing one weight against another weight thereby compressing the soft-coating and unlocking the plurality of connectors of one weight and the plurality of connectors of another weight from a locked position into a first engaged position, disengaging the plurality of connectors of one weight and the plurality of connectors of another weight from the first engaged position into a second engaged position, cease pressing one weight against another weight allowing the soft-coating to decompress and thereby disengaging the plurality of connectors of one weight and the plurality of connectors of another weight from the second engaged position into a disengaged position, separating the plurality of connectors of one weight and the plurality of connectors of another weight from the disengaged position. Additionally, this invention provides that the step of disengaging the plurality of connectors of one weight and the plurality of connectors of another weight from the first engaged position into a second engaged position comprises the step of turning one weight relative to another weight to move the plurality of connectors of one weight from the first engaged position to the second engaged position.

DETAILED DESCRIPTION OF THE PREFERRED EMBODIMENTS

Figure 1:
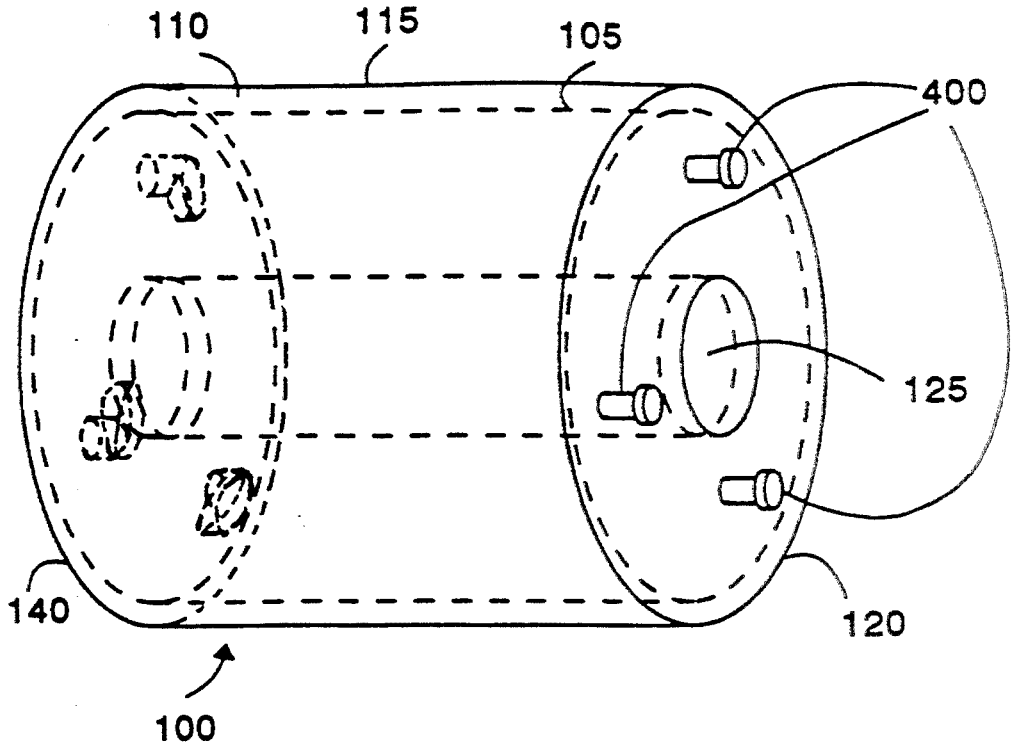
FIG. 1 is a perspective view of a weight ring of one embodiment of the present invention as seen from one end of the weight ring illustrating the side of a weight ring formed solely with post connectors.
Figure 2:
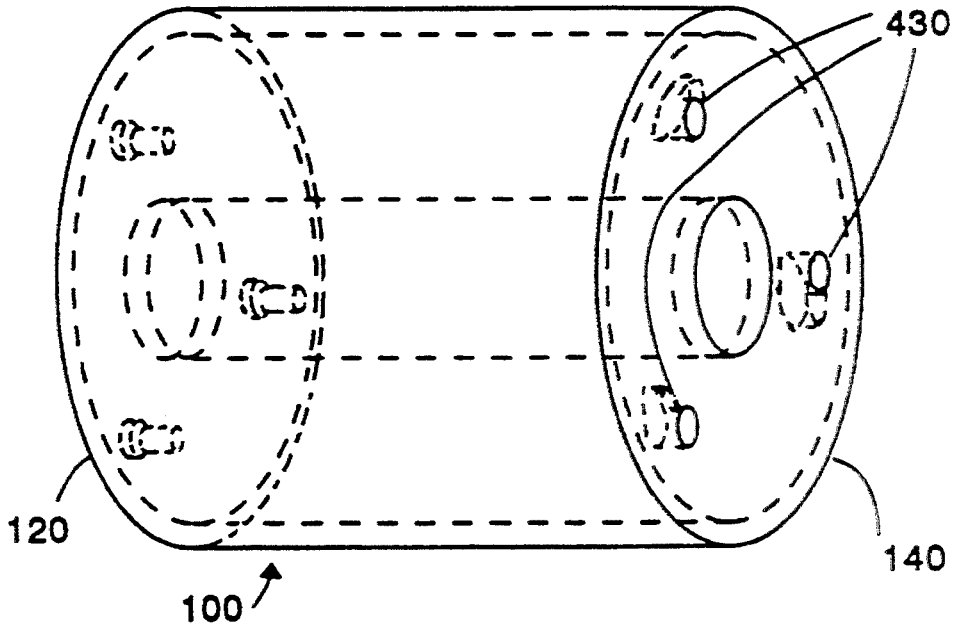
FIG. 2 is a perspective view of a weight ring of one embodiment of the present invention as seen from another end of the weight ring illustrating the side of a weight ring formed solely with receptacle connectors.

A perspective view of a weight ring 100 of one embodiment of the present invention is shown in FIGS. 1 and 2. The weight ring 100 is formed from a core ring 105 which is attached to a soft-coating 110 formed about the edge 115 and the sides 120, 140 of the weight ring 100. The soft-coating 110 is formed from neoprene plastic. However, the present invention also encompasses the use of other compressible resilient materials such as, but not limited to, rubber, other plastics or sponges. The core ring 105 is formed from metal, however, the present invention also encompasses the use of other weight materials, such as, but not limited to, concrete or sand.

Figure 3:
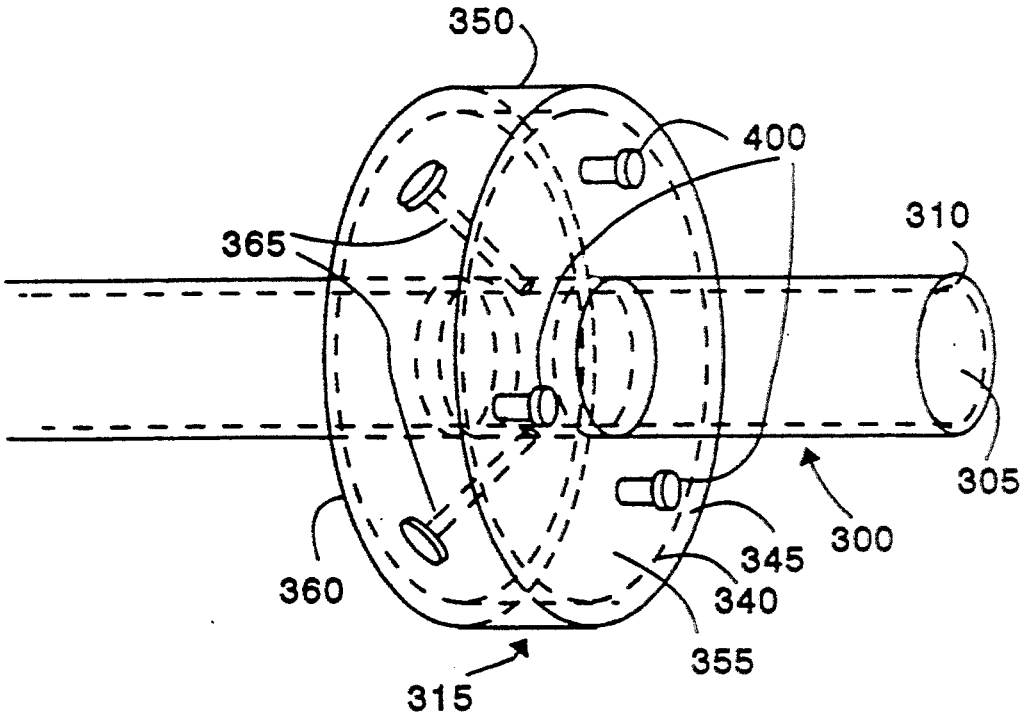
FIG. 3 is a perspective view of a rod of one embodiment of the present invention illustrating the rod and a collar ring formed with post connectors.

A perspective view of a rod 300 of the present invention is shown in FIG. 3. The rod 300 is formed from a core 305 which is at least partially enclosed in the same type of soft-coating 310 as the weight rings 100. However, the present invention also encompasses the use of an uncoated rod. Alternatively, the rod 300 can be formed from a number of soft coated, separate rod sections which are attached together. The attachment between the rod sections may be temporary, for example, by using screw-type connectors, so that the rod can be easily assembled for transportation and storage.

Figure 9:
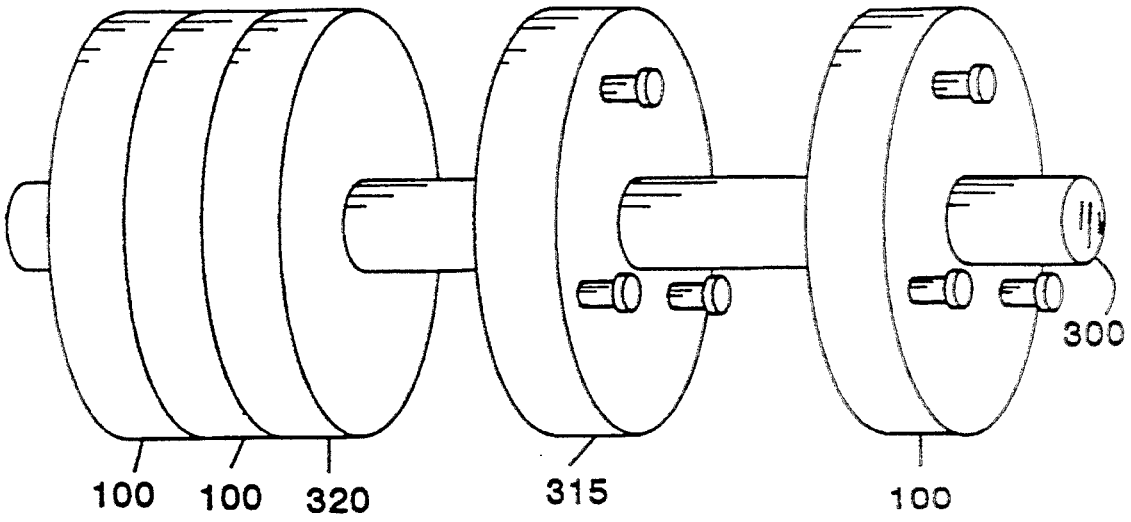
FIG. 9 is a perspective view of one embodiment of the present invention illustrating a rod with two collar rings, two connected weight rings and one weight ring in the process of being connected or removed.

In one embodiment, see FIGS. 3 and 9, two fixed or removable collar rings 315, 320 are attached to the rod 300. Each collar ring 315 is constructed similarly to the weight ring 100, that is, each collar ring 315 has a core ring 340 which is covered by a soft-covering 345 on the edge 350 and the sides 355, 360. However, the collar ring 315 is also attached to the rod 300. In this embodiment, the collar rings 315 are attached to the rod 300 by set screws 365. Other means of attachment include, but are not limited to: (1) forming the core ring 340 as part of the rod 300 or core 305, for example, the rod 300 and the core ring 340 can be cast as single unit; (2) welding or chemically bonding the core ring 340 to the rod 300, or (3) removably attaching the core ring 340 to the rod 300 by other mechanical connectors such as, but not limited to, ball bearings, rivets, etc.

A number of connectors 400, 430 are attached to one or both sides 120, 140, 355 of each weight ring 100 or collar ring 315. In one embodiment, see FIGS. 1–3, these connectors are located along a circumference defined by a fixed radial distance from the central hole 125, 335 of the weight ring 100 or collar ring 315, respectively. The present invention encompasses connectors 400, 430 of more than one type and the different types of connectors can be complementary to one another. While a preferred embodiment of the present invention employs three connectors on each side 120, 140 of the weight ring 100, the present invention is not limited to this number of connectors, see, for example, FIG. 6.

Figure 4:
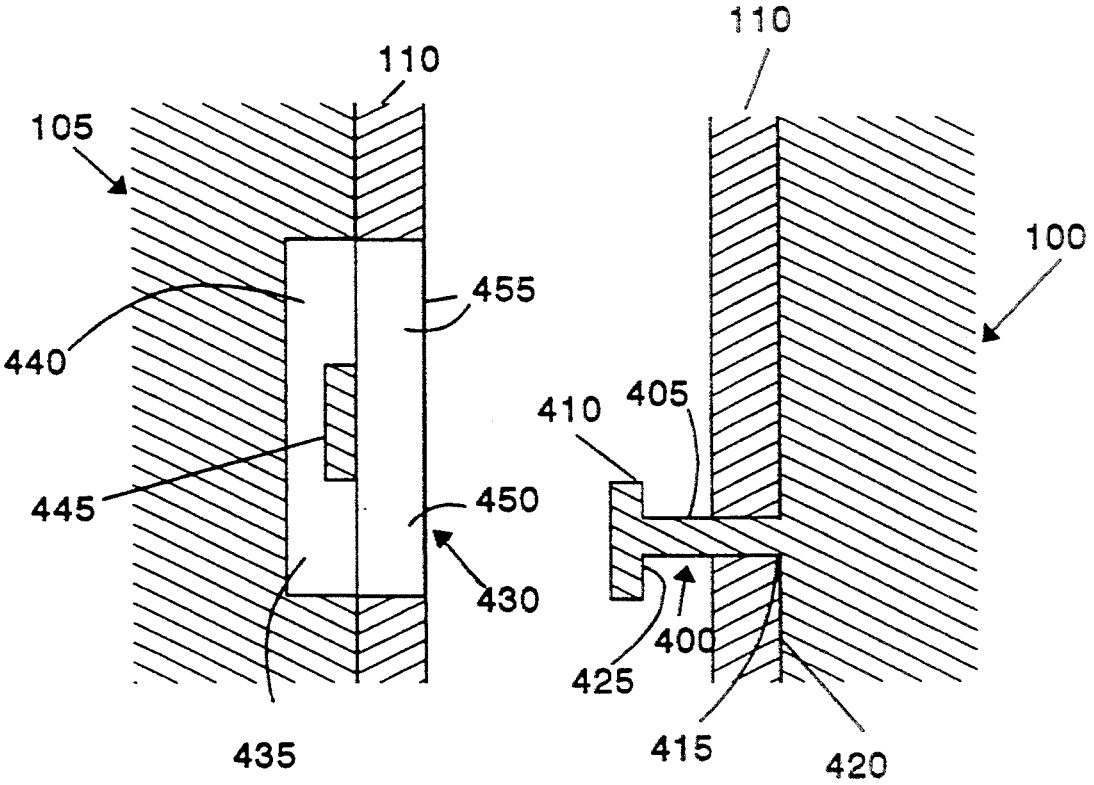
FIG. 4 is a cross-sectional partial side view of the post connector and the receptacle connector of one embodiment of the present invention illustrating the connectors when aligned.
Figure 5:
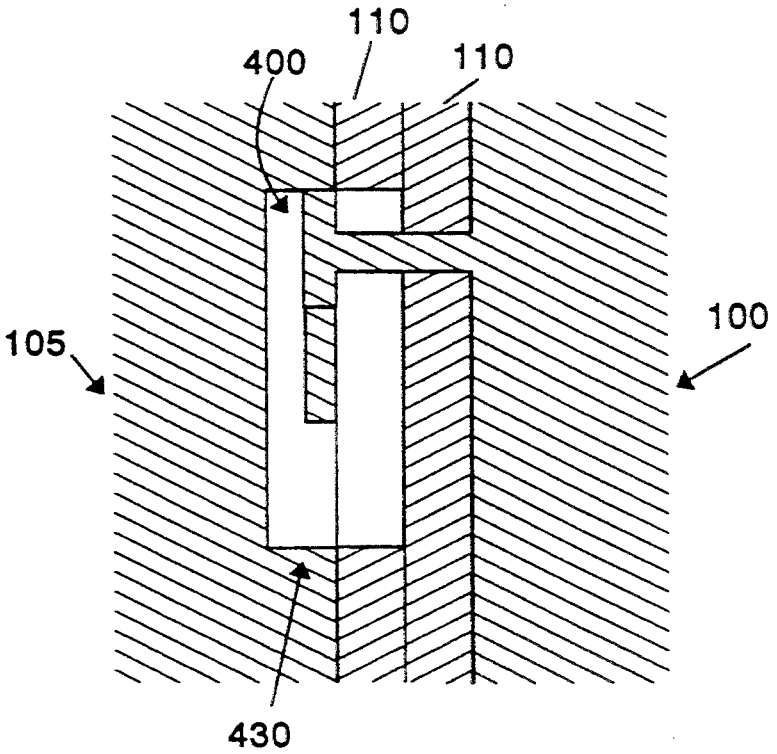
FIG. 5 is a cross-sectional partial side view of the post connector and the receptacle connector of one embodiment of the present invention illustrating the connectors locked together.
Figure 7:
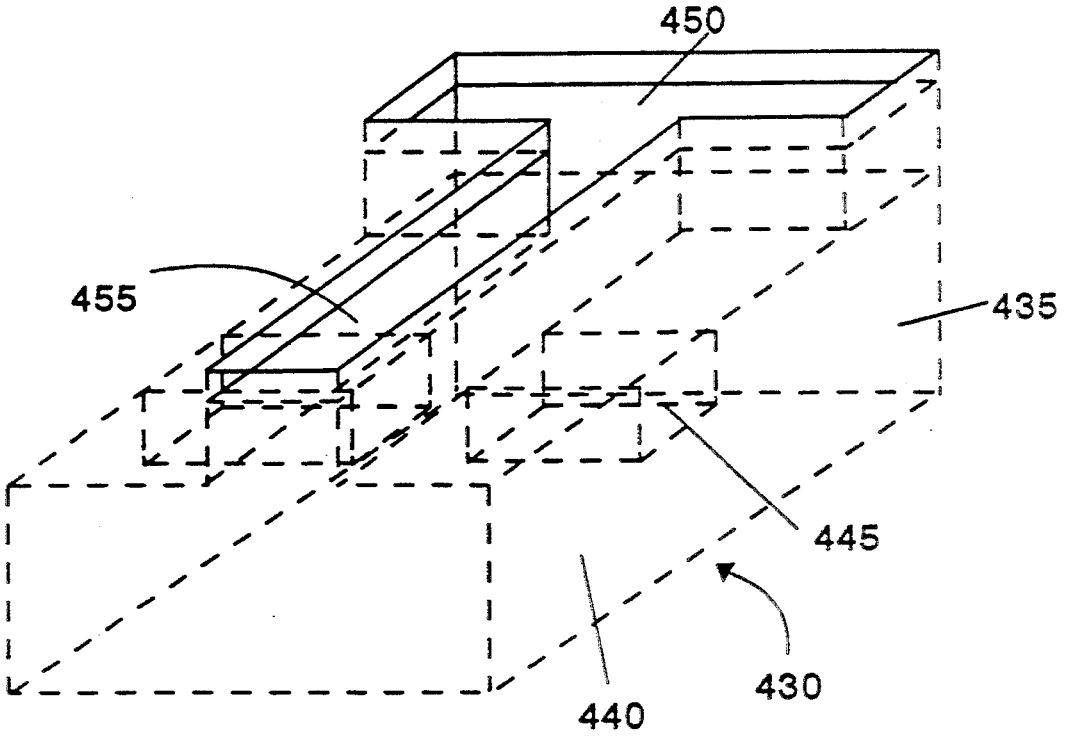
FIG. 7 is a perspective view of a receptacle connector of one embodiment of the present invention illustrating a receptacle connector which includes a lip for retaining a post connector.

In one embodiment of the present invention, two types of connectors 400, 430 are used. Each of the first connectors, see FIG. 4, is a post 400 having a bolt-like shape formed with a shaft 405 and a head 410. One end 415 of the shaft 405 is attached to or formed with the surface 420 of the core ring 105 and the other end 425 of the shaft 405 is attached to the head 410. Each of the second connectors, see FIGS. 4 and 7, is a receptacle 430 formed in the core ring 105 having a first region 435 and a second region 440. The first region 435 has an opening 450 which is large enough for receiving the head 410 of the post 400. The second region 440 has a narrower opening 455 which is large enough so that the shaft 405 of the post 400 can be slid along the opening 455 but is not large enough for the head 410 to be removed through the narrower opening 455. Between the two regions 435, 440, a lip 445 is formed to retain the head 410 in the second region 440 when two weight rings 100 are locked together. While the soft-coating 110 of this embodiment of the present invention does not provide for soft-coating the portion of the posts 400 and receptacles 430 which interconnect, the present invention also encompasses soft-coating the surface of either or both types of connectors.

To use the fitness exercise bar system of this embodiment, the user selects the desired weight rings 100 for his workout. The user slides the central hole 125 of one of these weight rings 100 onto the rod 300 with the side 140 formed with the receptacles 430 facing a collar ring 315. The user slides the weight ring 100 along the rod 300 until the weight ring 100 is adjacent to the collar ring 315. The user then aligns the posts 400 of the collar ring 315 with the receptacles 430 of the weight ring and simultaneously inserts each post 400 into the corresponding receptacle 430. After the head 410 of each of the posts 400 is inside the first region 435 of the corresponding receptacle 430, the user presses the weight ring 100 against the collar ring 315. This pressing compresses the soft-coatings 110, 315 formed on the side 140 of the weight ring 100 and on the side 355 of the collar ring 315 allowing the post 400 to be easily slid past the lip 445 and into the second region 440 of the receptacle 430 by a short turn of the weight ring 100 about the central hole 125. When the user stops pressing the weight ring 100 against the collar ring 315, the soft-coatings 110, 345 decompress pushing the weight ring 100 away from the collar ring 315. Accordingly, the head of the post 400 moves into the part of the second region 440 which is adjacent to the lip 445, thereby locking the weight ring 100 against the collar ring 315. To remove the weight ring 100, the process is reversed, that is, the user presses the weight ring 100 against the collar ring 315 compressing the soft-coating 110, 345. The user then turns the weight ring 110 a small amount in the opposite direction so that the head 410 of the post 400 moves past the lip 445 from the second region 440 into the first region 435. The head 410 can then be pulled through the opening 450 in the first region 435 of receptacle 430. Accordingly, The weight ring 100 then can be slid along and off the rod 300.

Additional weight rings 100 are added or removed using a similar procedure, that is, by connecting the receptacle side 140 of each weight ring 100 to the post side 120 of another weight ring 100 which is already attached to the collar ring 315 or to another weight ring 100.

Alternatively, the desired weight rings 100 for one side of the rod 300 can be connected to each other and then the entire assembly can be connected to the collar ring 315.

Although this embodiment is shown with a collar ring 315 formed with posts 400, the collar ring 315 can also be formed with receptacles 430. Since the weight rings 100 have both posts 400 and receptacles 430, the weight rings 100 can be used with rods 300 having either type of collar ring 315. Another alternative is to provide both types of connectors on the same side of the weight ring 100 and the collar ring 315, see FIG. 6, to require, for example, that the weight rings 100 be attached with a particular orientation.

Figure 8:
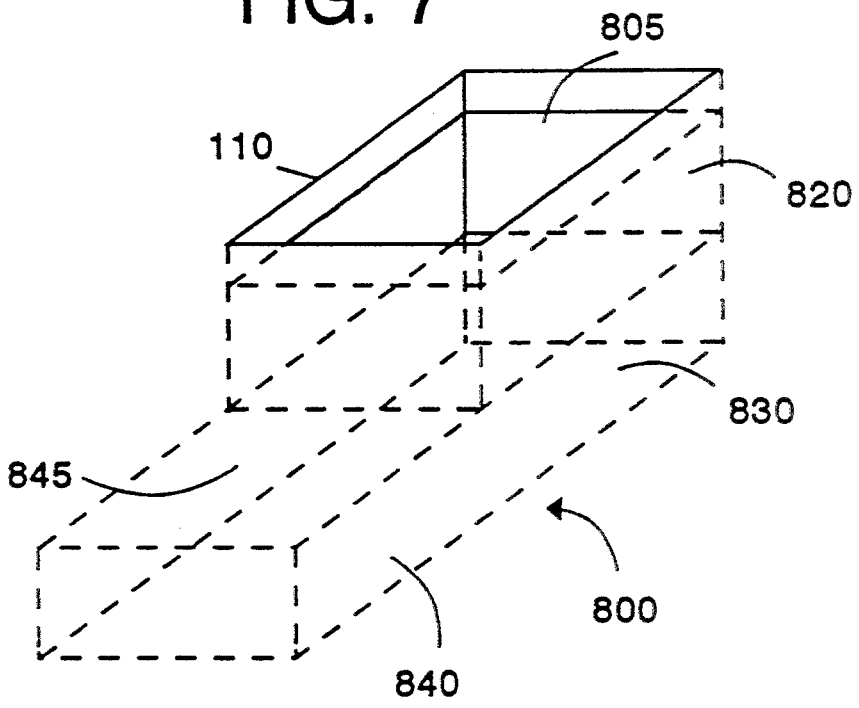
FIG. 8 is a perspective view of a receptacle connector of another embodiment of the present invention illustrating a receptacle connector with an indentation for retaining a post connector.
Figure 10:
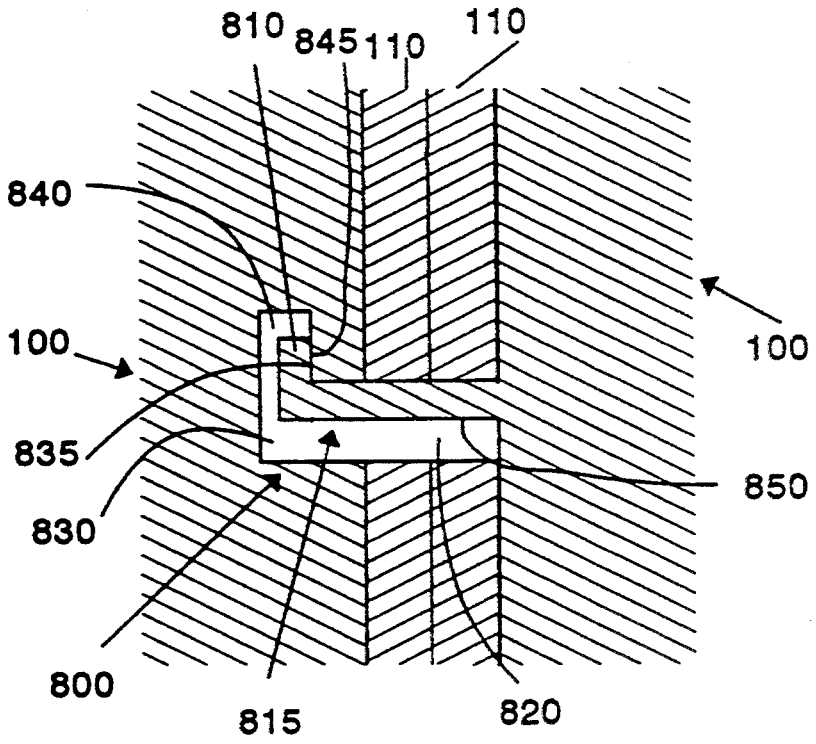
FIG. 10 is a cross-sectional partial side view of the post connector and receptacle connector of another embodiment of the present invention illustrating the connectors locked together.

In another embodiment of the present invention, the receptacle 800, see FIGS. 8 and 10, is formed with an opening 805 which is large enough to receive the head 810 of a post 815 into a first region 820. When the user compresses the soft-coatings 110, the head 810 moves into a second region 830. When the user turns the weight ring 100, an edge 835 of head 810 is moved into an indentation 840, such that when the user stops pressing the weight rings 100 together, the edge 835 of the head 810 is held against an edge 845 of the indentation 840 by the partially compressed soft-coatings 110. The soft-coatings 110 cannot totally decompress because the shaft 850 of the post 815 is shorter than the width of the uncompressed soft-coatings 110 and the depth of the first region 820. Accordingly, the edge 835 of the head 810 of each post 815 of one weight ring 100 is held against the respective edge 845 of the indentation 840 of each respective receptacle 830 of another weight ring 100 thereby locking two weight rings 100 together.

In one embodiment of the present invention, for example, a barbell, the core 305 of the rod 300 weighs approximately 4.5 kilograms and the soft-coating 310 is made from rubber or neoprene wrapping having a thickness of between 0.5 and 0.7 centimeters. Additionally, in this embodiment, the rod 300 is approximately 2.7 meters long and each weight ring 100 has a mass ranging from approximately 0.5 kilograms to 3.5 kilograms.

This present invention encompasses most types of fitness exercise systems, including, but not limited to, curl bars and dumbbells. Additionally, the parts of one piece of equipment are interchangeable with other pieces, for example, the same weight rings can be connected to different rods of the present invention, such as a curl bar or a dumbbell.

Figure 6:
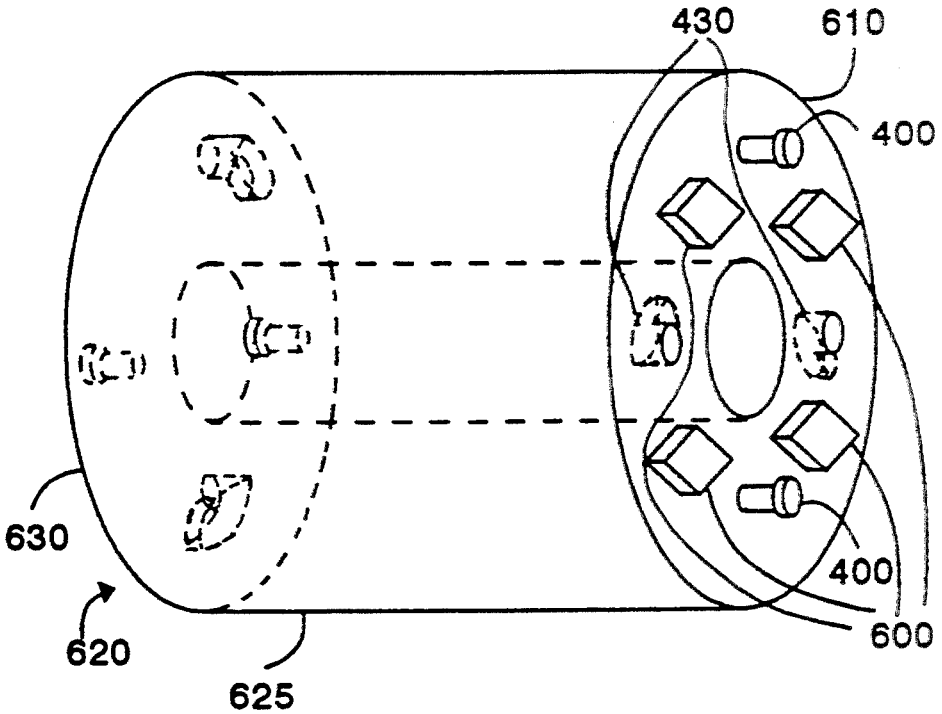
FIG. 6 is a perspective view of a weight ring of one embodiment of the present invention as seen from one end of the weight ring illustrating the side of a weight ring formed with two post connectors, two receptacle connectors and soft-coating on a portion of only one side.

In another embodiment of the present invention, see FIG. 6, only the sides 120, 140 or a portion of the sides of each weight ring 100 is covered by a soft-coating 600 since the compressive effect of the soft-coating 600 for locking purposes is only needed on the sides 120, 140 of the weight rings 100.

While a preferred embodiment of the present invention is to have the entire rod 300 and the sides 120, 140, 355, 360 and edges 115, 350 of both the collar rings 315, 320 and the weight rings 100 completely covered by the soft-coating 110, 345, the present invention also encompasses soft-coating only some of these areas or portions of these areas. For example, in one embodiment, only the one side 610 of the weight ring 615 has a partial non-contiguous soft-coating 600, while the core ring 620 is exposed on the edge 625 and the opposite side 630.

In one embodiment of the present invention, all the interchangeable weight rings 100 have a uniform outer diameter. Weight rings 100 of different masses can be made by varying the longitudinal length of the weight ring 100 because the longer the weight ring, the greater is the amount of material used. Alternatively, the different masses can be achieved by employing core rings 105, 340 made from materials having different densities.

This uniform outer diameter prevents a geometric imbalance from occurring when weights of different diameters are used. For example, in a typical weight lifting system, using a 1 kilogram weight and a 3 kilogram weight on one side of the bar and a 4 kilogram weight on the other side of the bar is not done because of the geometric imbalance caused by the different diameter weights. However, for the same example using the present invention, the only difference between the sides of the rod is the additional connection between the 1 kilogram weight ring and the 3 kilogram weight ring. Accordingly, there is no geometric imbalance.

Since the weight rings 100 can be attached to each other without the rod 300 or collar rings 315, the weight rings 100 can be connected to each other for storage. Furthermore, the connected weight rings 100 can also extend beyond the ends of the rod 300.

Another function of the soft-coating 110, 345 is to provide an outer surface which allows the weight rings 100 and rods 300 to be manufactured in different colors without changing the color of the core material. Additionally, since the soft-coating 110, 310 is at least several millimeters thick and the color is present throughout the soft-coating material scratches or dents into the soft coating 110, 345 have the same color as the outer surface of the soft-coating 110, 345 thereby maintaining the aesthetic appearance of the fitness bar system.

Although this invention has been described with respect to specific embodiments, many variations based on these specific embodiments can be made by a person of ordinary skill in the art without departing from the spirit of the disclosure or the scope of the appended claims. The embodiments are presented for the purposes of illustration only and should not be read as limiting the invention or its application. Therefore, the claims should be interpreted commensurate with the spirit and the scope of the invention.

What is claimed is:

1. A fitness exercise bar system comprising:

a rod comprising a central core and a first soft-coating attached to at least a portion of said central core;

a plurality of collar rings attached to said rod, each collar ring comprising a first core ring, a first central hole, a first edge, a first side, a second side, a first plurality of connectors formed in said first side and a second soft-coating attached to said first core ring to form a soft surface on said first side, said second side and said first edge; and a plurality of weight rings, each weight ring comprising a second core ring, a second central hole, a second edge, a third side, a fourth side, a second plurality of connectors formed in said third side, a third plurality of connectors formed in said fourth side and a third soft-coating attached to said second core ring to form a soft surface on said third side, said fourth side and said second edge;

such that said second plurality of connectors are adapted to connect to said first plurality of connectors and said second plurality of connectors are adapted to connect to said third plurality of connectors;

wherein each of said first plurality of connectors and each of said third plurality of connectors comprises a first type of connector and each of said second plurality of connectors comprises a second type of connector;

said first type of connector comprises a post comprising a shaft and a head, said head being wider in at least one dimension than said shaft; and said second type of connector comprises a hole comprising a first region and a second region, said first region comprising an opening for receiving said head and said second region comprising an indentation formed adjacent to the bottom of said first region;

such that the head of said post, when inserted into said hole, can be at least partially slid into said indentation.

2. A fitness exercise bar system according to claim 1, wherein:

said each weight ring and said each collar ring further comprises a predetermined diameter.

3. A fitness exercise bar system according to claim 1, wherein:

said first plurality of connectors comprise three connectors evenly spaced around a circumference at a predetermined radial distance from said first central hole;

said second plurality of connectors comprise three connectors evenly spaced around said circumference; and said third plurality of connectors comprise three connectors evenly spaced around said circumference.

4. A fitness exercise bar system according to claim 1, wherein:

said third soft-coating of each said weight ring, said second soft-coating of each said collar ring and said first soft-coating of said rod comprises rubber, plastic or neoprene wrapping.

5. A fitness exercise bar system comprising:

a rod comprising a central core:

a plurality of rings, each ring comprising a core ring having a first side and a second side, a plurality of connectors and a soft-coating attached to at least a portion of at least one of said sides of said core ring;

said plurality of connectors spaced in a configuration on at least one of said sides for aligning with a corresponding plurality of connectors spaced in said configuration on at least one side of another ring of said plurality of rings;

said plurality of connectors and said plurality of corresponding connectors comprise:

a first type of connector having a post comprising a shaft and a head, said head being wider in at least one dimension than said shaft; and a second type of connector having an elongate hole comprising a first region and a second region, said first region comprising an opening for receiving said head and said second region comprising an opening narrower in said at least one dimension than said head and wider in said at least one dimension than said shaft;

such that said post, when inserted into said elongate hole, can slide by rotation of said one ring relative to said another ring from said first region to said second region for attaching said connectors; and said soft-coating compresses for removably engaging said plurality of connectors on said one ring of said plurality of rings with said corresponding plurality of connectors on said another ring of said plurality of rings and at least partially decompresses for locking said plurality of connectors of said one ring to said corresponding plurality of connectors of said another ring.

6. A fitness exercise bar system according to claim 5, wherein said rod further comprises a soft-coating attached to at least a portion of said central core.

7. A fitness exercise bar system according to claim 5, where said plurality of rings comprises:

a plurality of weight rings; and a plurality of collar rings attached to said rod.

8. A fitness exercise bar system according to claim 5, wherein:

each ring of said plurality of rings comprises a predetermined diameter.

9. A fitness exercise bar system according to claim 5, wherein:

said configuration is said plurality of connectors and said corresponding plurality of connectors evenly spaced around a circumference at a predetermined radial distance from the center of said plurality of rings.

10. A fitness exercise bar system comprising:

rod comprising a central core;

a plurality of rings, each ring comprising a core ring having a first side and a second side, a plurality of connectors and a soft-coating attached to at least a portion of at least one of said sides of said core ring;

said plurality of connectors spaced in a configuration on at least one of said sides for aligning with a corresponding plurality of connectors spaced in said configuration on at least one side of another ring of said plurality of rings;

said plurality of connectors and said plurality of corresponding connectors comprise:

a first type of connector having a post comprising a shaft and a head, said head being wider in at least one dimension than said shaft; and a second type of connector having a hole comprising a first region and a second region, said first region comprising an opening for receiving said head and said second region comprising an indentation formed adjacent to the bottom of said first region:

such that said head of said post, when inserted into said hole, can be at least partially slid by rotation of said one ring relative to said another ring into said indentation for attaching said connectors; and said soft-coating compresses for removably engaging said plurality of connectors on said one ring of said plurality of rings with said corresponding plurality of connectors on said another ring of said plurality of rings and at least partially decompresses for locking said plurality of connectors of said one ring to said corresponding plurality of connectors of said another ring.

11. A fitness exercise bar system according to claim 10, wherein:

each of said plurality of connectors of said one ring comprise said first type of connector; and each of said corresponding plurality of connectors of said another ring comprises said second type of connector which is complementary to said first type of connector.

12. A fitness exercise bar system according to claim 10, wherein said rod further comprises a soft-coating attached to at least a portion of said central core.

13. A fitness exercise bar system according to claim 10, where said plurality of rings comprises:

a plurality of weight rings; and a plurality of collar rings attached to said rod.

14. A fitness exercise bar system according to claim 10, wherein:

each ring of said plurality of rings comprises a predetermined diameter.

15. A fitness exercise bar system according to claim 10, wherein:

said configuration is said plurality of connectors and said corresponding plurality of connectors evenly spaced around a circumference at a predetermined radial distance from the center of said plurality of rings.

16. A fitness exercise bar system according to claim 5, wherein:

each of said plurality of connectors of said one ring comprise said first type of connector; and each of said corresponding plurality of connectors of said another ring comprises said second type of connector which is complementary to said first type of connector.

* * * * *